United States Patent [19]

Morris

[11] Patent Number: 4,681,551

[45] Date of Patent: Jul. 21, 1987

[54] AQUATIC DEVICE

[76] Inventor: Richard S. Morris, 817 Orleans Pl., Raleigh, N.C. 27609

[21] Appl. No.: 798,247

[22] Filed: Nov. 4, 1985

[51] Int. Cl.[4] ..... A63C 15/02

[52] U.S. Cl. ..... 441/76; 441/77

[58] Field of Search ..... 441/60, 55, 65–67, 441/75–77

[56] References Cited

U.S. PATENT DOCUMENTS 2,707,789 5/1955 Brown ..... 441/77
3,952,353 4/1976 Word ..... 441/76

FOREIGN PATENT DOCUMENTS 558815 8/1932 Fed. Rep. of Germany ..... 441/77
753248 7/1956 United Kingdom ..... 441/77

*Primary Examiner*—Jeffrey V. Nase
*Assistant Examiner*—C. T. Bartz
*Attorney, Agent, or Firm*—Mills and Coats

[57] ABSTRACT

This invention is an improved aquatic means wherein a standard, readily available tire inner tube is fitted with special bindings that gives a double end, boat-like configuration and allows the foot of the user thereof to be readily inserted into and released from the device.

4 Claims, 6 Drawing Figures

FIG. 1
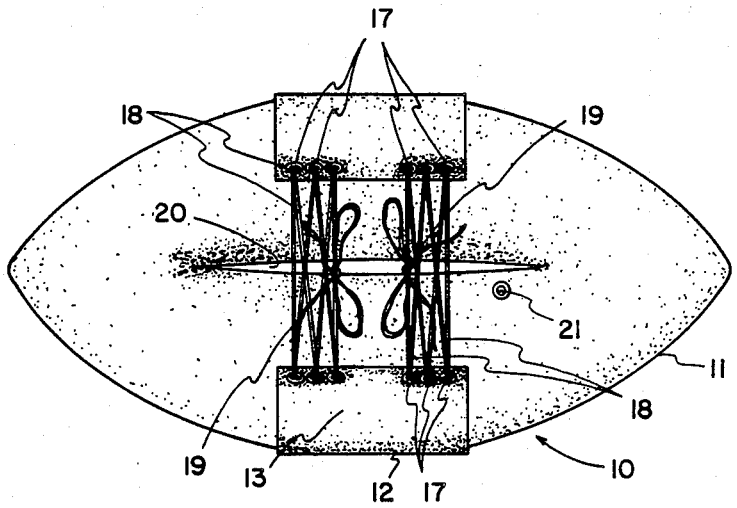
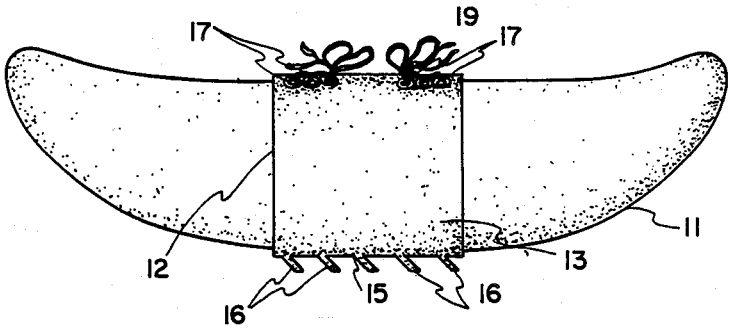
FIG. 2
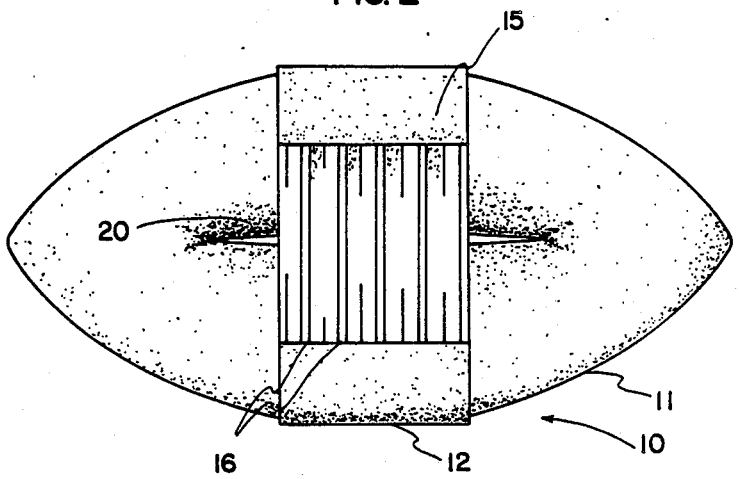
FIG. 3

FIG. 4
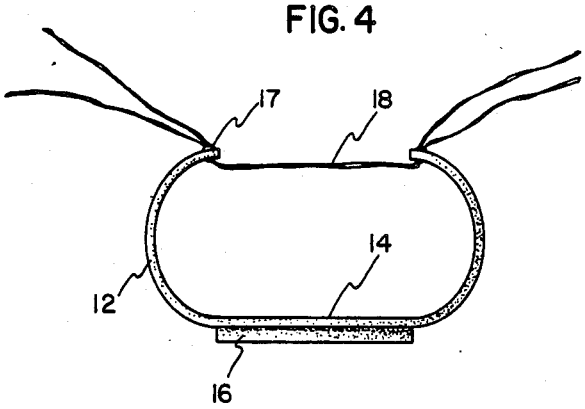
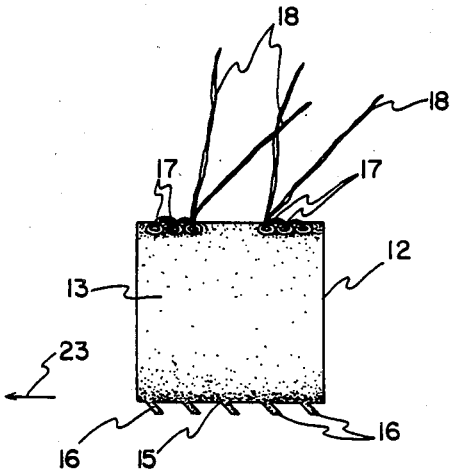
FIG. 5
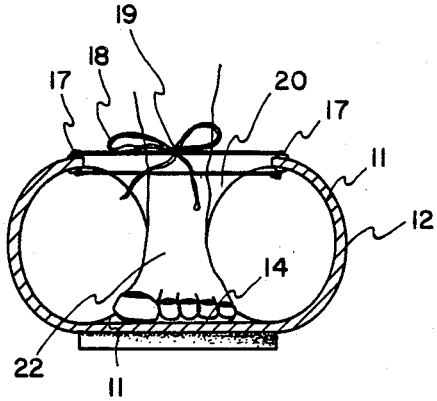
FIG. 6

AQUATIC DEVICE

FIELD OF INVENTION

This invention relates to aquatic devices and more particularly to water shoe type means.

BACKGROUND OF INVENTION

Since man first began to encounter bodies of water that he wished to cross, he has been in the market for improved flotation means.

Although various types of boats including folding boats and inflatable boats have been used as more or less personal flotation means to prevent the user thereof from getting wet while traversing the surface of a body of water, these are bulky, relatively heavy and certainly cannot be considered readily portable.

Although some experimentation has been conducted in water shoe type devices, these experiments have generally had the same instances being either inadequate from a flotation aspect or simply were inadequate for the purpose intended.

BRIEF DESCRIPTION OF INVENTION

After much research and study into the above-mentioned problems, the present invention has been developed to provide an improved personal flotation means in the form of readily inflatable and deflatable, easily storable and transportable and yet highly buoyant water shoe type means for traversing the surface of water.

The above is accomplished through the provision of a cinch means which is drawn around a generally donut-shaped inflatable means such as an inner tube to form a double ended, boatlike configuration. A platform is provided at the bottom of the cinch with the upper portion typing in front of and behind the foot of the user thereof. Unidirectional paddle bars are provided on the lower portion of the platform to allow propulsion of the aquatic means.

In view of the above, it is an object of the present invention to provide a relatively inexpensive and yet highly efficient means for allowing the user thereof to transverse across the surface of water.

Another object of the present invention is to provide a means used in conjunction with standard inner tube type inflatable means for converting such inner tube to a support means for walking on the surface of water.

Another object of the present invention is to provide lightweight, readily portable personal flotation devices which attach to the feet of the user thereof.

Another object of the present invention is to provide a pair of highly maneuverable water shoes for water walking.

Other objects and advantages of the present invention will become apparent and obvious from a study of the following description and the accompanying drawings which are merely illustrative of the present invention.

BRIEF DESCRIPTION OF FIGURES

FIG. 1 is a top perspective view of the aquatic device of the present invention;

FIG. 2 is a side elevational view thereof;

FIG. 3 is a bottom plan view thereof;

FIG. 4 is an end elevational view of the cinch portion of the present invention;

FIG. 5 is a side elevational view thereof; and

FIG. 6 is a sectional view showing device's manner of use.

DETAILED DESCRIPTION OF INVENTION

The aquatic device of the present invention, indicated generally at 10, is composed of an inflatable portion 11 and a cinch portion 12. The inflatable portion is preferably a donut-shaped member such as a tire inner tube which, when pulled together by the cinch portion 12, forms a double ended, canoe-like configuration as shown in FIGS. 1 through 3.

The cinch portion 12 is composed of a cinch sheath 13 which, when disposed as shown in the figures, has secured to the bottom portion 14 thereof a propulsion plate 15 which has a plurality of angularly disposed paddles or bars 16 fixedly attached thereto.

A cinch sheath securing means such as a plurality of eyelets 17 interconnected by lacing means 18 and tied as indicated at 19 is provided.

To use the aquatic device of the present invention, a standard donut shaped inflatable means such as an inner tube is partially inflated and is folded in the middle with the normal round center hole therein now forming a slot-like opening as indicated at 20. The cinch portion 12 is then slipped over the inner tube 11 to hold the configuration shown in FIGS. 1 through 3. More air can now be added as needed for appropriate firmness and adequate inflation through a normal means such as valve steam 21.

The foot 22 of the user thereof can now be inserted into the slot-like opening 20 so that it rests on the bottom portion 14 of cinch sheath 13. The cinch securing means can then be drawn up snug by pulling laces 18 and secured by tying of knots 19. The user can then move into the water where the inflatable portion 11 of each of the devices will support the weight of such user on the surface thereof.

Because of the angle propulsion bars 16 are set relative to plate 15, the device of the present invention will readily move in the direction of arrow 23 and yet will not readily move in the opposite direction thereby allowing the user to move with a sliding motion, first one foot forward and then the other in a manner similar to a cross country skier thereby propelling himself along.

Whenever the user of the present invention wishes to remove the same from his feet 22, all that is necessary is to loosen the cinch securing means 18 and remove the foot from the device.

Although eyelets and lacing means have been shown as the securing means for the cinch portion 12, it is to be understood that other suitable means such a Velcro type hook and eye means, straps and buckles, and the like could be substituted there for.

From the above it can be seen that a relatively simple, inexpensive and yet highly efficient aquatic device is provided which is highly efficient in use. This device is lightweight, is readily portable, and is storable in a small space when not in use.

The present invention can, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A water-walking apparatus comprising: a donut-shaped tube; cinch means for compressing said donut-shaped tube into a double-ended, canoe-like configuration, said cinch means including an elongated band extending around said tube, the opposite ends of said band including adjustable attachment means for drawing one end of said band towards the other end to compress said tube; and a plurality of downwardly projecting, angularly disposed propulsion means secured to said cinch means to allow said water-walking apparatus to move more readily in one direction than in the opposite direction whereby an improved water-walking apparatus is provided.

2. The means of claim 1 wherein said cinch means includes a bottom portion.

3. The means of claim 1 wherein said donut-shaped tube is a vehicle tire inner tube.

4. The means of claim 1 wherein said adjustable attachment means is a lacing means.

* * * * *